US010117473B2

(12) United States Patent
Sullivan et al.

(10) Patent No.: US 10,117,473 B2
(45) Date of Patent: Nov. 6, 2018

(54) HAND PROTECTION AND COVERING

(71) Applicant: Hand Out, Inc., Sandy, UT (US)

(72) Inventors: Jake L. Sullivan, Sandy, UT (US); Donahue Wildman, Malibu, CA (US)

(73) Assignee: Hand Out, Inc., Sandy, UT (US)

( * ) Notice: Subject to any disclaimer, the term of this patent is extended or adjusted under 35 U.S.C. 154(b) by 225 days.

(21) Appl. No.: 15/051,242

(22) Filed: Feb. 23, 2016

(65) Prior Publication Data

US 2016/0249694 A1 Sep. 1, 2016

Related U.S. Application Data

(60) Provisional application No. 62/121,877, filed on Feb. 27, 2015.

(51) Int. Cl.
*A41D 19/00* (2006.01)
*A41D 19/01* (2006.01)

(52) U.S. Cl.
CPC ..... *A41D 19/01* (2013.01); *A41D 19/0013* (2013.01); *A41D 19/0017* (2013.01); *A41D 19/0048* (2013.01)

(58) Field of Classification Search
CPC ..... A41D 19/01; A41D 19/0017; A41D 19/0013; A41D 19/0048
See application file for complete search history.

(56) References Cited

U.S. PATENT DOCUMENTS 480,852 A * 8/1892 Kahn ..... A41D 19/01 2/158
1,786,227 A 12/1930 Bruggeman
2,118,463 A 5/1938 Eden
2,274,335 A 2/1942 Kennedy
2,315,889 A 4/1943 Wells
2,318,785 A * 5/1943 Kopplin ..... A41D 19/01 2/158

(Continued)

FOREIGN PATENT DOCUMENTS

FR 1482070 5/1967
WO WO2007072509 6/2007

OTHER PUBLICATIONS

Website https://www.youtube.com/watch?v=qLwv91eN_Mg "Get Your Hand Out! Hand Out Gloves and 15 Mittens [Review]" (Lukasavige) Feb. 19, 2015 (Feb. 19, 2015) 2 pgs.

(Continued)

*Primary Examiner* — Khaled Annis
(74) *Attorney, Agent, or Firm* — John P. Davis; Thayne and Davis LLC

(57) ABSTRACT

A hand covering configured to enclose a human hand, having a dorsal side and a palm side is disclosed. The hand covering comprises a wrist portion and a hand portion. In some embodiments, the hand portion includes at least one digit receptacle and a thumb receptacle. In certain embodiments, an arcuate opening may be formed in the dorsal side of the hand covering extending from a lateral portion of the hand covering positioned opposite the thumb receptacle, across the dorsal side of the hand covering, and to the thumb receptacle. A closure fastener may be operably attached to the arcuate opening and configured to open and close the arcuate opening such that a user can remove a thumb and digit from the hand portion without moving the wrist portion.

16 Claims, 13 Drawing Sheets

(56) References Cited

U.S. PATENT DOCUMENTS

| | | | | | |
|---|---|---|---|---|---|
| 2,451,837 | A | * | 10/1948 | La Londe | A41D 19/01 2/158 |
| 2,549,660 | A | | 4/1951 | Buhl et al. | |
| 2,743,453 | A | * | 5/1956 | Singer | A41D 19/01 2/158 |
| 2,830,299 | A | | 4/1958 | Thilenius | |
| 2,836,828 | A | | 6/1958 | Henrikson | |
| 3,299,441 | A | | 1/1967 | Slimovitz | |
| 4,408,358 | A | | 10/1983 | Swan | |
| 4,615,049 | A | | 10/1986 | Samelian | |
| 4,704,743 | A | | 11/1987 | Thornell et al. | |
| 4,791,683 | A | | 12/1988 | Agee | |
| 4,868,927 | A | | 9/1989 | Bourdeau et al. | |
| 5,375,263 | A | | 12/1994 | Cuccia | |
| 5,444,874 | A | | 8/1995 | Samelian et al. | |
| 5,509,143 | A | * | 4/1996 | Yates | A41D 19/01535 2/158 |
| 5,542,125 | A | * | 8/1996 | Zuckerwar | A41D 19/00 2/158 |
| 5,699,632 | A | | 12/1997 | Stout et al. | |
| 5,711,032 | A | | 1/1998 | Carpenter | |
| 5,815,837 | A | | 10/1998 | Christman et al. | |
| D410,957 | S | | 6/1999 | Hubsher | |
| 6,338,163 | B1 | | 1/2002 | Markson | |
| 6,581,211 | B1 | | 6/2003 | Golden | |
| D489,149 | S | | 4/2004 | Horner | |
| 6,810,530 | B2 | | 11/2004 | Bryant, Sr. | |
| 6,996,847 | B2 | | 2/2006 | Anderson et al. | |
| 7,937,773 | B1 | | 5/2011 | Kleinert | |
| 8,104,098 | B1 | | 1/2012 | Kleinert | |
| 8,458,817 | B1 | | 6/2013 | Babb | |
| 9,204,675 | B2 | | 12/2015 | Mack | |
| 2003/0154536 | A1 | | 8/2003 | Anderson et al. | |
| 2005/0102732 | A1 | | 5/2005 | Nakagawa | |
| 2006/0212989 | A1 | | 9/2006 | White | |
| 2006/0260022 | A1 | * | 11/2006 | Vaughn | A41D 19/01 2/163 |
| 2007/0136928 | A1 | | 6/2007 | Dolenak | |
| 2007/0266474 | A1 | | 11/2007 | Grilliot et al. | |
| 2008/0222773 | A1 | | 9/2008 | Vaughn | |
| 2011/0203031 | A1 | | 8/2011 | Vaughn | |
| 2013/0074241 | A1 | | 3/2013 | Gellis | |
| 2014/0359916 | A1 | | 12/2014 | Baunach | |

OTHER PUBLICATIONS

Nebsite https://www.youtube.com/watch?v=usPCX6ntjpw "Hand Out Gloves Pro Glove" to (Trailspace) 19 Jan. 21, 2015 (2 pgs).
Website https://www.youtube.com/watch?v=ZccXW_P7Gs8 "Hand. Out Gloves—How They Work!" (Stevenson) Jan. 21, 2014 (2 pgs).
Written Opinion for PCT/US16/19408, dated May 13, 2016, 7 pgs.
International Search Report for PCT/US16/19408, dated May 13, 2016, 3 pgs.
FR 1482070—Machine Translation.
Final Office Action issued in U.S. Appl. No. 11/133,069, dated Nov. 15, 2007, 8 pgs.
Office Action issued in U.S. Appl. No. 11/133,069, dated Apr. 17, 2007, 8 pgs.
Office Action issued in U.S. Appl. No. 11/133,069, dated Oct. 10, 2006, 7 pgs.
Final Office Action issued in U.S. Appl. No. 11/133,069, dated Jun. 13, 2006, 7 pgs.
Office Action issued in U.S. Appl. No. 11/133,069, dated Dec. 28, 2005, 6 pgs.
Office Action issued in U.S. Appl. No. 12/077,538, dated Aug. 19, 2010, 8 pgs.
Final Office Action issued in U.S. Appl. No. 13/032,468, dated Jan. 18, 2012, 9 pgs.
Office Action issued in U.S. Appl. No. 13/032,468, dated Sep. 29, 2011, 7 pgs.
Website https://www.youtube.com/watch?v=AmHCLbaYf9o "Vaughn Originals Demo" Dec. 16, 2013, 3 pgs.
Website https://www.youtube.com/watch?v=rmiXQkqkx98 "VO Gloves—Vaughn Originals—KickStarter" Dec. 16, 2013, 2 pgs.
Website https://www.youtube.com/watch?v=5ISU-Gkc4m8 "10 Peaks Gloves—C-Zip Technology" Dec. 2, 2013, 2 pgs.
Internet Article: http://www.snewsnet.com/news/vo-workhorse-gloves/, "VO Workhorse Gloves", SNEWS Article, Published Feb. 28, 2007, 4 pgs.
Internet Article: http://www.businesswire.com/news/home/20060123005351/en/Zip-Off-Gloves-Hit-Winter-Sports-Market-Vaughn, "Zip-Off Gloves Hit the Winter Sports Market; New Vaught Outdoor CZip™ Gloves & Mittens Unzip Across Knuckles, Stay Securely Attached to Provide Winter Athletes Convenient Access", Businesswire Article Published Jan. 23, 2006, 2 pgs.
Internet Article: http://www.powpowpow.org/10-peaks-a-new-concept-for-gloves/, "10 Peaks: A New Concept for Gloves" 6. PowPowPow Article, Published Feb. 5, 2015, 5 pgs.
Website https://www.youtube.com/watch?v=nOcxPB3phPk "Burton Hi-Five Mitt SKU: #7928880" Nov. 13, 2012, 1 pg.
Website https://www.youtube.com/watch?v=ZMO2On9wkkE "LOKI—Access Mitt" Sep. 12, 2007, 1 pg.
Website issuu—https://issuu.com/soolid/docs/howl_fw14_catalog—Howl Supply Snow Fall winter 2014 Catalog—Jan. 14, 2014, 1 pg.
Website Transworld Snowboarding—http://snowboarding.transworld.net/photos/five-misty-mitts/3/#v0j7LSBdyc58sqzQ.97—Five Misty Mitts—Feb. 3, 2011, 4 pgs.
Website Transworld Snowboarding—https://www.kickstarter.com/projects/332418412/vo-gloves-vaughn-originals/description—VO Gloves—Vaughn Originals/Kickstarter—Dec. 20, 2013, 16 pgs.

* cited by examiner

HAND PROTECTION AND COVERING

RELATED APPLICATIONS

This application claims the benefit of priority under 35 U.S.C. § 119(e) to provisional application Ser. No. 62/121,877 entitled "HAND PROTECTION AND COVERING," filed on Feb. 27, 2015, which is hereby incorporated by reference in its entirety.

SUMMARY

The disclosure relates generally to devices, systems, and methods for protecting and covering a user's hand(s), such as gloves, mittens, other hand coverings, and the like. Gloves and mittens may, among other things, be used to protect and insulate human hands in a variety of environments and for a variety of uses. For example, work gloves may comprise a sturdy material, such as leather, that protects and covers the wearer's bare hands from, inter alia, friction, cuts, scrapes, burns, and other injuries. As another example, gloves or mittens used for cold weather or outdoor recreation such as skiing or snowboarding may be worn to insulate the wearer's hand in cold weather conditions.

Work gloves (or work hand coverings) and/or ski gloves (or winter hand coverings) may be relatively bulky in comparison to a wearer's hand. The bulk of certain hand coverings may cause the wearer to be less sensitive with respect to touch and feel of objects picked up by a hand that is protected by such a covering. Consequently, wearing gloves or other hand coverings can make deft manipulation of small objects, such as car keys or cell phones, relatively difficult. Accordingly, users may remove coverings from their hand in order to accomplish tasks that require use of the fingers and thumb.

Complete removal of a hand covering to accommodate use of the fingers is not always desirable. At certain times, complete removal of a glove or hand covering involves inconvenience or risk to the wearer. Removing gloves while riding a ski lift, for example, creates a risk of dropping a loose glove from the lift, thereby exposing a user's bare hand to the cold climate conditions. Additionally, completely removing a work glove in certain industrial environments could expose the worker's hand to injury.

Certain gloves and/or mittens may include various openings positioned to allow a portion of a wearer's fingers to be extracted from the glove or mitten without removing the glove or mitten or substantially exposing the wearer's hand. Similarly, certain hand coverings may comprise detachable portions that can be removed to expose a wearer's fingers. In some instances, however, exposure of the fingers alone may not give the hand sufficient exposure to accomplish many tasks and/or provide adequate freedom to the fingers to provide the wearer with sufficient dexterity to manipulate many small objects.

Certain embodiments of the devices, systems and methods disclosed herein may more efficiently protect and cover a user's hands for various purposes. Some embodiments may, among other things, protect and cover a user's hand or hands in an effective and elegant manner. Embodiments of the devices, systems and methods disclosed herein may provide a hand covering for protecting and/or otherwise covering a user's hand(s) while allowing a portion of the hand covering to be easily and conveniently partially detached from the other portion of the hand covering to allow the user to deftly use his or her bare fingers and/or thumb without removing the entire hand covering. In some embodiments, this operation may preserve and/or otherwise substantially keep intact a seal between and/or around a user's hand covering and other protective equipment (e.g., a jacket cuff and/or the like).

BRIEF DESCRIPTION OF THE DRAWINGS

Non-limiting and non-exhaustive embodiments of the disclosure are described with reference to the following figures, wherein like reference numerals may refer to like parts throughout the various views.

DETAILED DESCRIPTION

Figure 1:
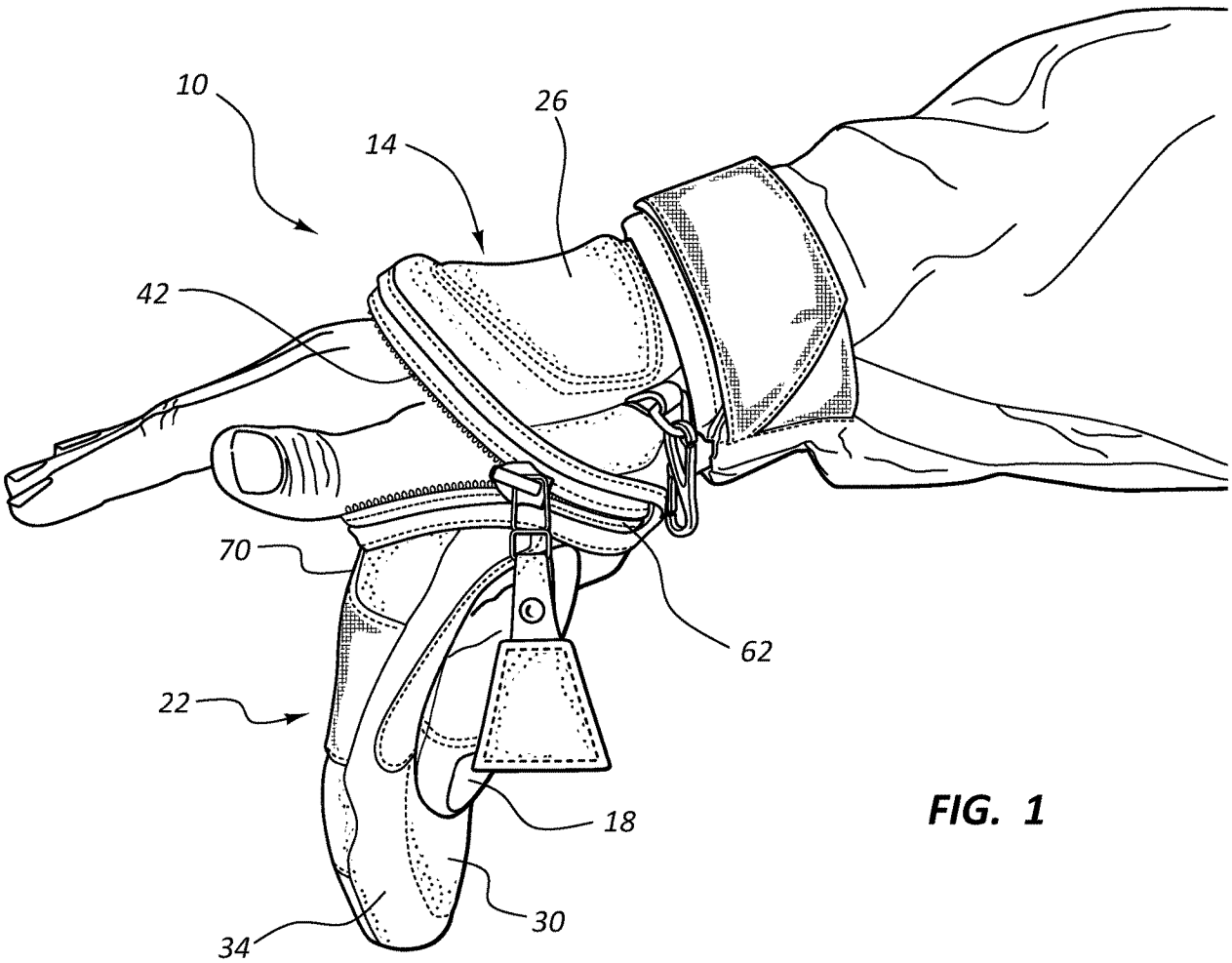
FIG. 1 is a side view of a hand covering shown in an open configuration consistent with embodiments disclosed herein.
Figure 2:
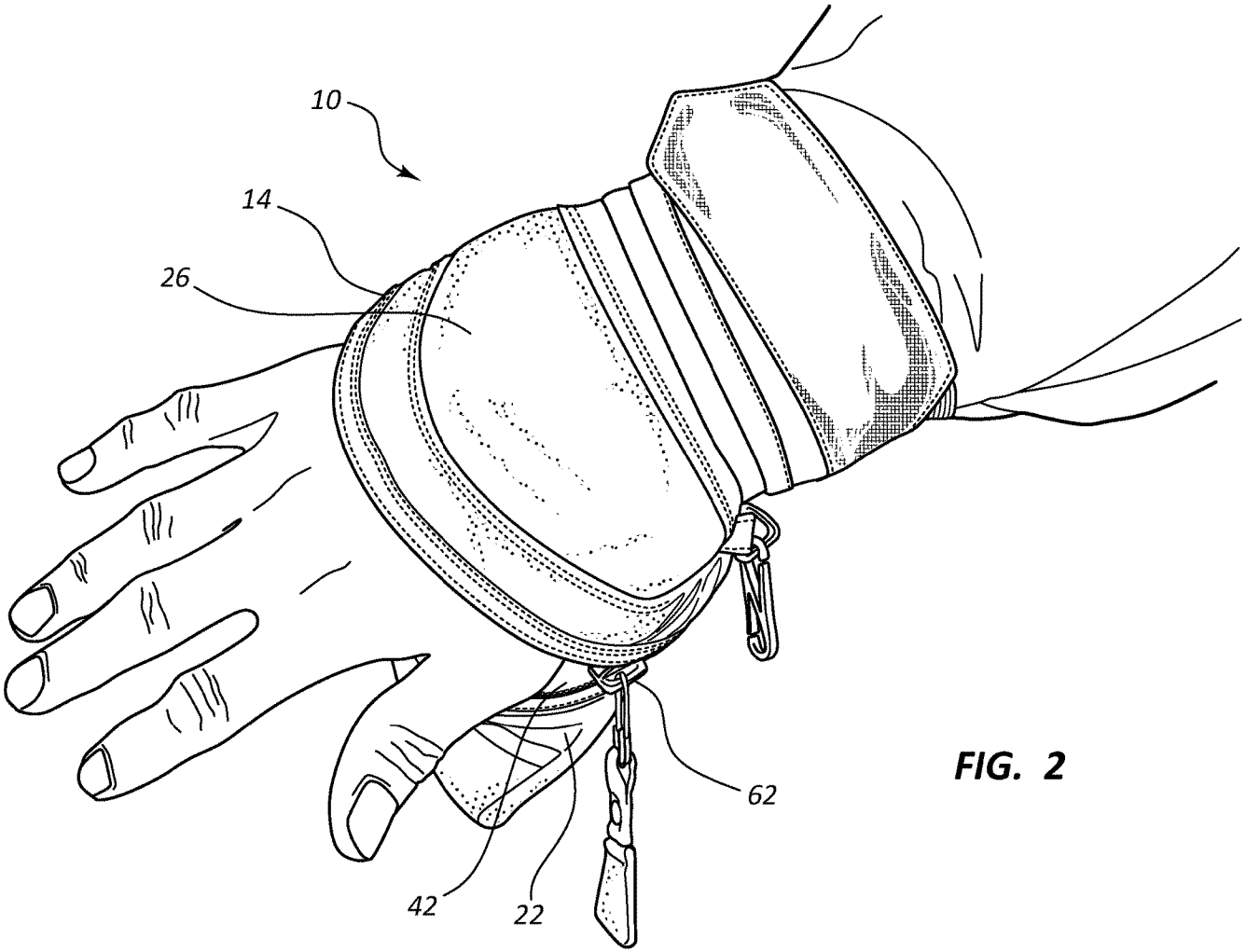
FIG. 2 is a top view of the hand covering of FIG. 1, shown in an open configuration, consistent with embodiments disclosed herein.

A detailed description of systems and methods consistent with embodiments of the present disclosure is provided below. While several embodiments are described, it should be understood that the disclosure is not limited to any one embodiment, but instead encompasses numerous alternatives, modifications, and equivalents. In addition, while numerous specific details are set forth in the following description in order to provide a thorough understanding of the embodiments disclosed herein, some embodiments can be practiced without some or all of these details. Moreover, for the purpose of clarity, certain technical material that is known in the related art has not been described in detail in order to avoid unnecessarily obscuring the disclosure.

Some embodiments of the disclosure may be understood by reference to the drawings, wherein like parts may be designated by like numerals. The components of the disclosed embodiments, as generally described and illustrated in the figures herein, could be arranged and designed in a wide variety of different configurations. Thus, the following detailed description of certain illustrative embodiments is not intended to limit the scope of the disclosure, as claimed, but is merely representative of possible embodiments of the disclosure. In addition, the steps of any method disclosed herein do not necessarily need to be executed in any specific order, or even sequentially, nor need the steps be executed only once, unless otherwise specified.

Embodiments of the devices, systems and methods disclosed herein may relate to a hand covering for protecting and/or otherwise covering a user's hand(s) while allowing a portion of the hand covering to be easily and conveniently partially detached from the other portion of the hand covering to allow the user to deftly use his or her bare fingers and/or thumb without removing the entire hand covering. In some embodiments, this operation may preserve and/or otherwise substantially keep intact a seal between and/or around a user's hand covering and other protective equipment (e.g., a jacket cuff and/or the like).

Certain embodiments disclosed herein are directed to a hand covering, such as a glove or mitten, that may, among other things, be configured to allow removal of the fingers and thumb, expose the palm of the hand, keep the dorsal part of the hand covered, reduce interference between the hand and the hand covering when the covering is partially removed from the hand, and/or maintain a seal between and/or around a user's hand covering and other protective equipment. The hand covering can be used in a variety of applications, including recreational activities, construction environments, manufacturing environments, etc. The hand covering can also be used (e.g., when formed from an insulated material and/or the like) in a variety of outdoor activities, such as outdoor work sites; snow sports, such as skiing, snowboarding, snowmobiling, and ice fishing; and motorcycling etc.

Some embodiments provide for a hand covering that can expose the fingers, thumb, and/or palm of the hand while remaining attached to the wrist of the wearer. In certain embodiments, this may preserve and/or otherwise keep intact a seal between and/or around a user's hand covering and other protective equipment (e.g., a jacket cuff and/or the like). Further embodiments may maintain coverage of the dorsal side of the hand when the fingers, thumb and/or palm are exposed, further keeping intact the seal between and/or around a user's hand covering and other protective equipment. Certain embodiments of a partially removable hand covering disclosed herein may allow a wearer to use his or her fingers and/or thumb outside of the covering without completely removing the covering from the wearer's wrist, thereby substantially persevering a seal between and/or around a user's hand covering and/or other protective equipment.

In some embodiments, the hand covering can be configured to enclose a human hand, fingers and thumb. The hand covering may comprise a dorsal side and a palm side. The hand covering may further comprise a wrist and/or forearm and a hand portion. The hand portion may comprise at least one digit receptacle and a thumb receptacle. The thumb receptacle may be located on or near a thumb side of the hand covering. For example, the thumb receptacle may be located on a side of the hand covering that corresponds to a thumb or a distal radius of a user. The thumb receptacle may be placed on a palm side of the hand covering on or near the thumb side of the hand covering. Opposite the thumb side, the hand covering may include a lateral side corresponding to a pinky side or ulna side of a user's hand.

An arcuate opening may be formed in the dorsal side of the hand covering, and may extend from a lateral portion located on or near a lateral side of the hand covering, across the dorsal side, to a location at the thumb receptacle. In some embodiments, the opening may extend from the lateral side across a full length of the dorsal side, around the thumb side and to a thumb receptacle of the user. The arcuate opening may be configured to allow the user to remove his or her digits and thumb from the digit receptacle and/or the thumb receptacle, while the wrist and/or forearm portion remains attached to the wearer and covers a dorsal side of the wearer's hand, thereby keeping intact the seal between and/or around a user's hand covering and other protective equipment. In certain embodiments, a closure device or a closure fastener can be operably attached to the arcuate opening to allow the arcuate opening to be selectively closed and opened by the wearer even while the wearer's hands are covered by the hand covering. In other words, a wearer may need not remove the hand covering from either hand to selectively open and close the closure device or closure fastener.

In further embodiments, the arcuate opening can have a curvature that corresponds, at least in part, to a natural shape of the user's knuckles. For example, the arcuate opening may be formed on the dorsal side of the hand covering in a position directly over the user's knuckles, and at least a portion of the curvature of the arcuate opening may correspond to a curved line passing over the user's knuckles. In some embodiments, the curve of the arcuate opening may be positioned slightly beyond (closer to the fingertips) or before (closer to the wrist) of the user. The curvature of the opening may allow for substantially all of the proximal phalanges of a hand to be exposed upon opening of the arcuate opening.

In other embodiments, the arcuate opening may extend from the lateral portion of the hand covering to a portion of the thumb receptacle approximately corresponding to a metacarpophalangeal joint of the user. For example, the curvature of the arcuate opening may follow the natural curvature of the user's knuckles across the dorsal side of the hand covering, and then extend at least to a position approximately corresponding to the metacarpophalangeal joint of the user, such that the user can easily remove the thumb from the hand covering when the arcuate opening is opened. In further embodiments, the arcuate opening may extend from the lateral portion of the hand covering to a portion of the thumb receptacle approximately corresponding to a carpometacarpal joint of the user. For example, the curvature of the arcuate opening might follow the natural curvature of the user's knuckles across the dorsal side of the hand covering, and then extend at least to a position approximately corresponding to the carpometacarpal joint of the user, such that the user can easily remove the thumb from the hand covering when the arcuate opening is opened.

In yet further embodiments, the curvature of the arcuate opening can be shaped such that the arcuate opening extends from the lateral portion of the hand covering to a portion of the thumb receptacle and across the thumb receptacle from a point approximately corresponding to a metacarpophalangeal joint of the user to a point approximately corresponding to a carpometacarpal joint of the user. In such embodiments, the curvature of the arcuate opening might follow the natural curvature of the user's knuckles across the dorsal side of the hand covering, and then curve sharply across the thumb receptacle such that the arcuate opening extends across a point approximately corresponding to a metacarpophalangeal joint of the user and a point approximately corresponding to a carpometacarpal joint of the user. In further embodiments, the thumb receptacle may have a thumb receptacle width, and the arcuate opening can extend from the lateral portion of the hand covering to the thumb receptacle and across substantially the entire thumb receptacle width.

Consistent with embodiments disclosed herein, the hand covering can comprise a structural member located proximate to the arcuate opening and/or portions thereof. In some embodiments, the structural member may be located in a position parallel and/or substantially parallel to the arcuate opening and/or a portion thereof. In certain embodiments, the structural member may be affixed interior to a portion of the hand covering. For example, the structural member may be included in an interior channel defined by the hand covering and/or otherwise affixed at an internal location proximate to the arcuate opening (e.g., affixed using adhesive, stitching, and/or the like). In further embodiments, the structural member may be affixed external to the hand covering.

Among other things, the structural member may be configured to enable the user to selectively open and close the arcuate opening without substantially altering the curvature of the arcuate opening. For example, the structural member may stiffen the region near the arcuate opening to allow a zipper and/or other closure device or closure fastener to slide and/or otherwise articulate more easily along the opening. In certain embodiments, this may prevent the zipper, closure device or closure fastener from binding as a user attempts to articulate the zipper, device, or fastener during operation. In certain embodiments, this may better enable a user to fasten or release the opening using a single hand.

The structural member may comprise a variety of suitable materials and be configured in a variety of suitable ways. As discussed in detail below, the structural member may comprise plastic, metal, rubber and/or any other suitable material. In further embodiments, the structural member may comprise additional padding at and/or proximate to the arcuate opening. The padding may be thicker than or more rigid than other portions of the hand covering. The additional padding may be formed in the hand portion of the hand covering or in the wrist portion of the hand covering. Among other things, the additional padding can be configured to enable the user to selectively open and close the arcuate opening without substantially altering the curvature of the arcuate opening. That is, the additional padding may prevent the hand covering from substantially flexing when the user is selectively opening or closing the arcuate opening. In certain circumstances, the additional padding may enable a user to easily open and close the arcuate opening with one hand.

In further embodiments, the structural member may comprise a portion of material surrounding the arcuate opening that is rigid and/or more rigid to improve ease in closing or opening the opening using a device and/or fastener. In some embodiments, a similar fabric or material may be used but may be packed with more padding, more dense padding, or the like to increase resistance of the portion to changing shape. The portion of the material surrounding the arcuate opening may still be a soft and flexible material, but may be stuffed more densely or include additional padding layers to keep a desired shape of the material on one or both sides of the arcuate opening. For example, the extra padding, thicker fabric, a strip or length of fabric, or material may be included near the opening and may stiffen the region near the opening to allow a zipper to slide more easily along the arcuate opening. This may enable a user to fasten or release the opening using a single hand (e.g., the user's other gloved or bare hand).

In some embodiments, the wrist portion may further comprise an extended cuff portion. The extended cuff portion can, for example, extend over or under the user's additional protective equipment (e.g., a jacket). The extended cuff portion may extend onto or past a radiocarpal joint of the user. For example, an extended cuff portion may extend about two or more inches past the radiocarpal joint, about four or more inches past the radiocarpal joint, and/or about six inches or past the radiocarpal joint, although other suitable distances are also contemplated. In other embodiments, the wrist portion may further comprise a securing device coupled to the wrist portion and configured to temporarily or selectively secure the hand portion of the hand covering to the palm side of the forearm portion of the hand covering when the arcuate opening is opened. For example, the user might open the arcuate opening, remove his or her digits and thumb from the hand portion, and then secure the hand portion to the forearm portion such that the user's hand can freely move without being obstructed by the hand covering. In further embodiments, the closure fastener can further comprise an oversized tab configured to enable the user to grasp and navigate or manipulate the closure fastener while the user's opposite hand is disposed in a separate hand covering.

Further embodiments disclosed herein provide a method for covering a hand while allowing for selective access to objects by bare fingers and a thumb of a wearer can include enclosing the wearer's hand with a hand covering. In some embodiments, a seal between and/or around a user's hand covering and other protective equipment may be preserved and/or otherwise kept substantially intact. In some embodiments, a closure device or closure fastener can be operably attached to an arcuate opening formed in the dorsal side of the hand covering between the hand portion and the wrist and/or forearm portion. The hand covering may be parted at the opening to expose the digits and thumb of the wearer while maintaining coverage of a dorsal portion of the wearer's hand as well as maintaining the seal between and/or around a user's hand covering and other protective equipment. In some embodiments, the hand covering can be bent about the palm side of the hand covering downward from the wearer's hand, without breaking the seal between and/or around a user's hand covering and other protective equipment. In further embodiments, the arcuate opening can extend from a lateral portion of the hand covering opposite a thumb receptacle formed in the hand portion, across the dorsal side of the hand covering, and to the thumb receptacle. The hand covering can further comprise a structural member (e.g., additional padding) at the arcuate opening configured to enable the user to selectively open and close the arcuate opening without substantially altering a curvature of the arcuate opening.

As illustrated in FIGS. 1-5, an openable hand covering 10 in accordance with various embodiments of the disclosure can be configured with an enclosure that encloses or covers a human hand, fingers and thumb. It will be appreciated that the term "hand covering" is broadly interpreted to include any hand covering, and not just a glove or mitten as illustrated and described herein. Various exemplary embodiments of gloves and mittens may be used in the disclosure for the sake of clarity and illustration only. It will be appreciated that the features and principles of the disclosure may be utilized in conjunction with any hand covering without departing from the spirit or scope of the disclosure. Moreover, certain embodiments disclosed herein may be utilized in connection with clothing and/or coverings for a variety of other applications (e.g., head coverings, foot coverings, etc.).

The hand covering 10 may have a dorsal side 26 and a palm side 30. In some embodiments, the hand covering 10 may comprise a wrist and/or forearm portion 14, and a hand portion 22. The hand portion 22 may comprise a thumb receptacle 18 and/or a digit receptacle 34. In certain embodiments, the hand portion 22 can be at least partially integrally joined to the wrist and/or forearm portion 14.

As used herein, the term "dorsal side" 26 of the hand covering may refer to a side of the hand covering 10 that corresponds to a back or dorsal side of a human hand over which the covering 10 is to be disposed. Similarly, the term "palm side" 30 of the hand covering 10 may refer to the opposing side of the hand covering that corresponds to the palm of a human hand over which the covering 10 is to be disposed. In certain embodiments, the hand covering may comprise at least two sections: a "hand portion" 22 which includes, but is not necessarily limited to, a portion of the hand covering 10 that covers the fingers and the thumb; and a "wrist and/or forearm portion" 14 that includes, but is not necessarily limited to, a portion of the hand covering 10 that covers the wrist and/or the forearm. The wrist and/or forearm portion 14 may be used to form a seal between and/or around a user's hand covering 10 and other protective equipment. As used herein the term "seal" may refer to the concept of joining two things together, such as the hand covering 10 and other protective equipment, such as a ski jacket and/or other clothing, so as to reduce the potential for movement therebetween or material and/or environmental conditions from passing between them, such as cold air or snow, for example.

Figure 13:
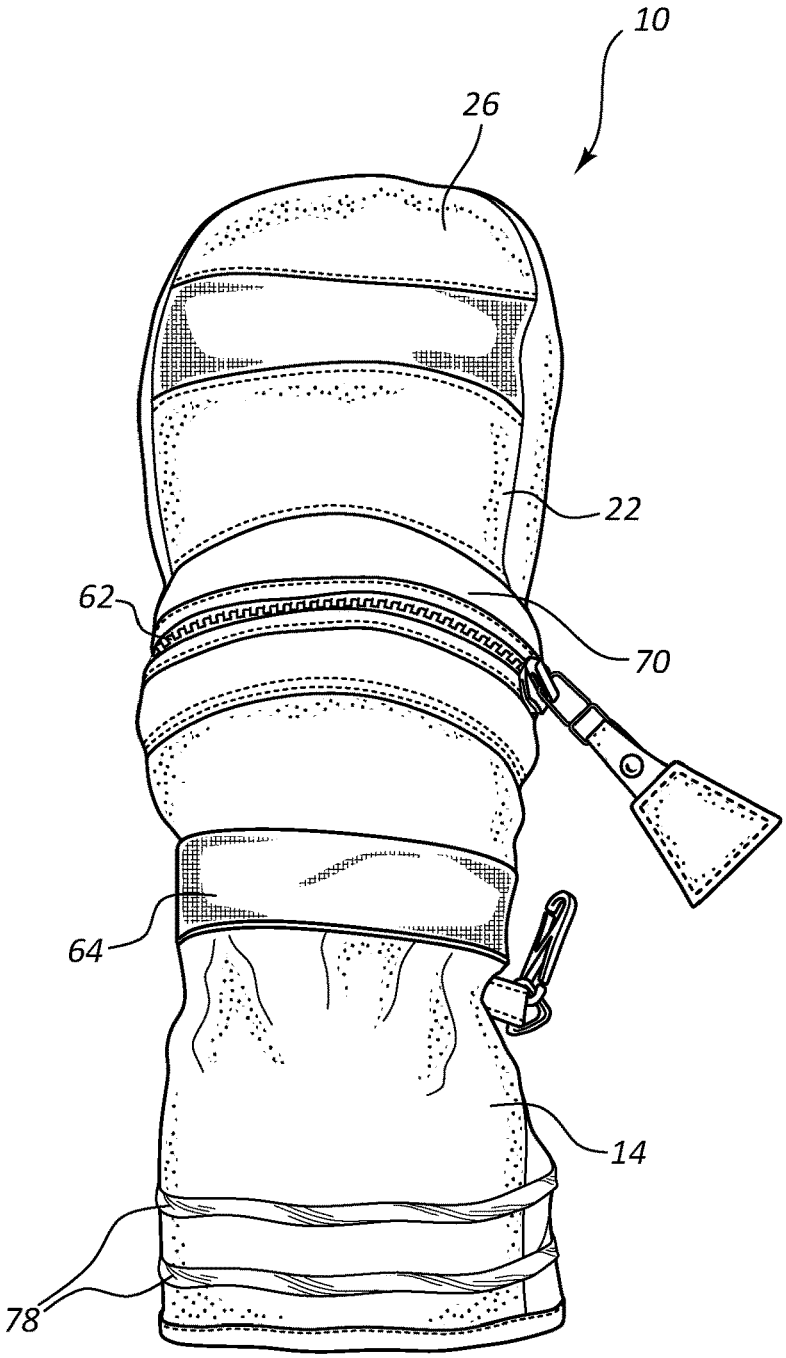
FIG. 13 illustrates a top view of a hand covering in a closed configuration and associated higher frictional areas of a wrist portion of the hand covering consistent with embodiments disclosed herein.

In some embodiments, as illustrated in FIG. 13, the wrist and/or forearm portion 14 may comprise one or more areas 78 having increased frictional resistance. In certain embodiments, these areas 78 may operate to reduce the potential for the hand covering 10 to slide against the inside of protective equipment, such as the cuff of a ski jacket and/or other clothing, thereby improving the seal between and/or around a user's hand covering 10 and other protective equipment. As illustrated, the areas 78 may comprise one or more bands of higher frictional material and/or coating disposed around the wrist and/or forearm portion 14. In further embodiments, the higher frictional areas 78 may comprise any suitable pattern and/or combination of pattern on the wrist and/or forearm portion 14 configured to maintain a seal between and/or around a user's hand covering 10 and other protective equipment. The higher frictional areas 78 may comprise any suitable material including, without limitation, rubber and/or rubberized materials, plastic material, leather and/or simulated leather, fabric material, and/or the like, and may be affixed to the hand covering 10 using any suitable mechanism including, without limitation, adhesives, stitching, and/or the like.

In further embodiments, the shape of the wrist and/or forearm portion 14 (e.g., a narrowed portion) and/or elastic materials included in the cuff may further reduce the potential for the hand covering 10 to slide down a user's wrist during operation. In some embodiments, the interior of the wrist and/or forearm portion 14 and/or other portions of the hand covering 10 may include higher frictional materials, including any of the materials disclosed herein, to reduce the potential of the hand covering 10 from sliding relative to a user's wrist during use and/or operation.

Figure 3:
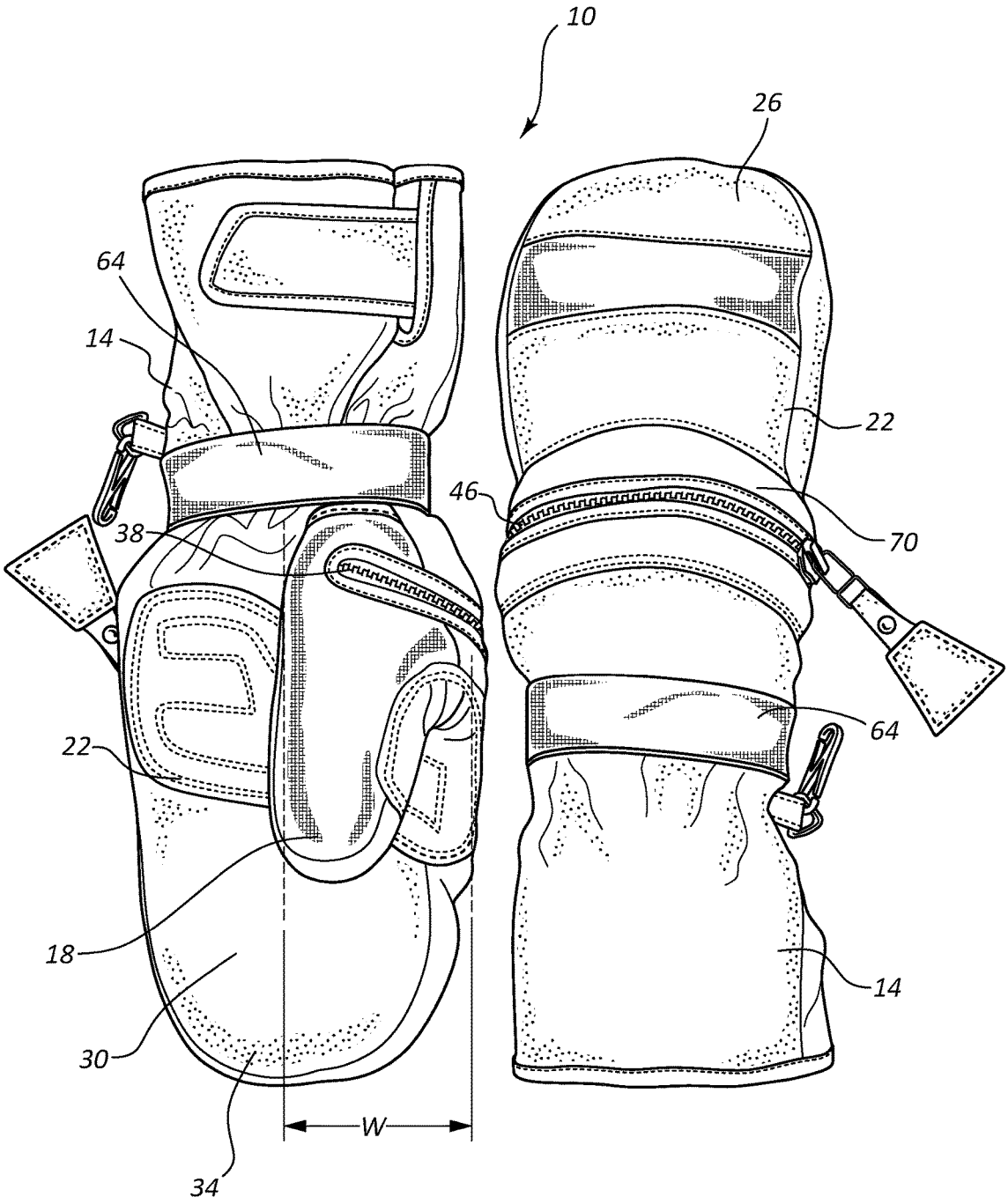
FIG. 3 is a bottom and top view, respectively from left to right on the page, of the hand covering of FIG. 1 in a closed configuration, consistent with embodiments disclosed herein.
Figure 4:
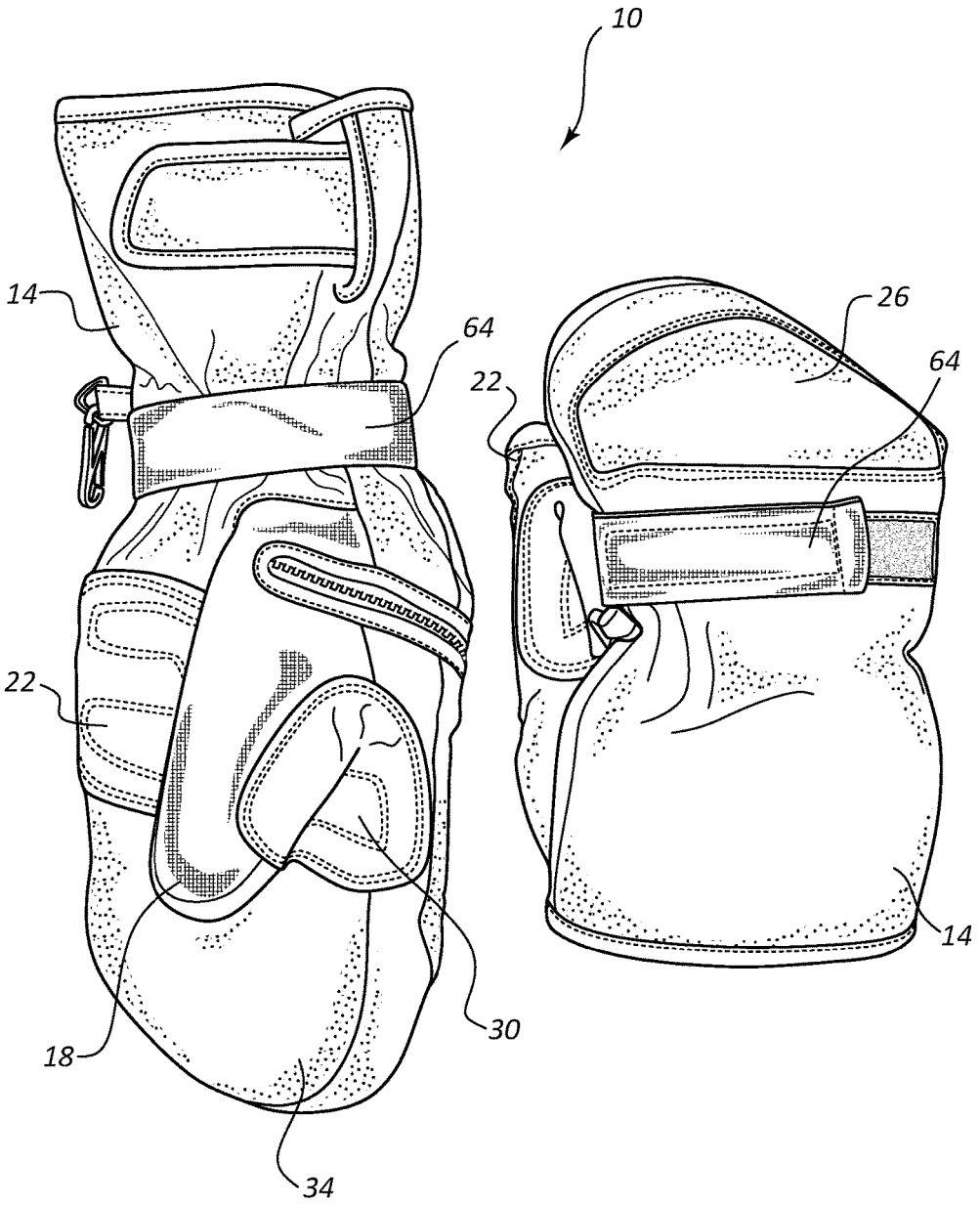
FIG. 4 is a bottom and top view, respectively from left to right on the page, of the hand covering of FIG. 1, with the bottom view showing the hand covering in a closed configuration and the top view showing the hand covering in an open configuration, consistent with embodiments disclosed herein.
Figure 5:
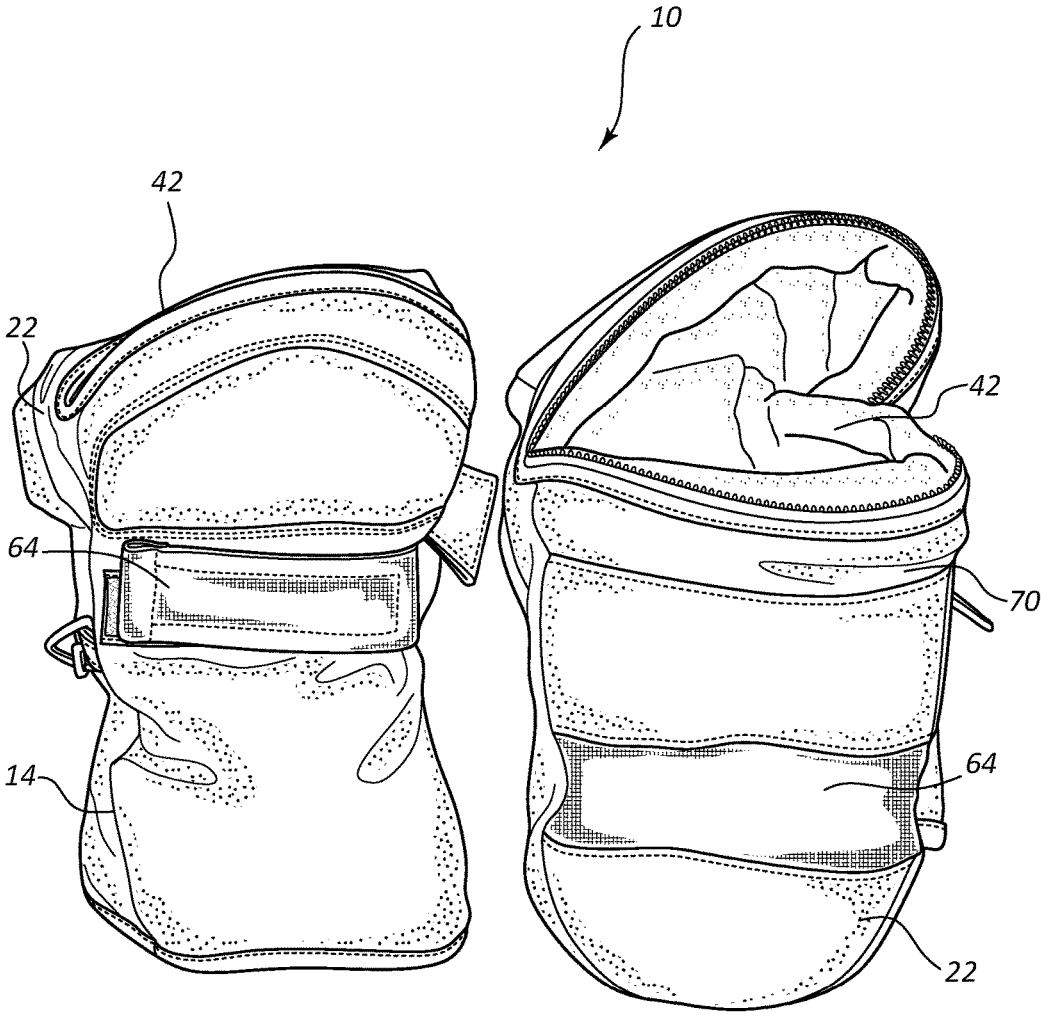
FIG. 5 is a top and bottom view, respectively from left to right on the page, of the hand covering of FIG. 1, with the top view showing the hand covering in an open configuration and the bottom view showing the hand covering in an open configuration, consistent with embodiments disclosed herein.
Figure 6:
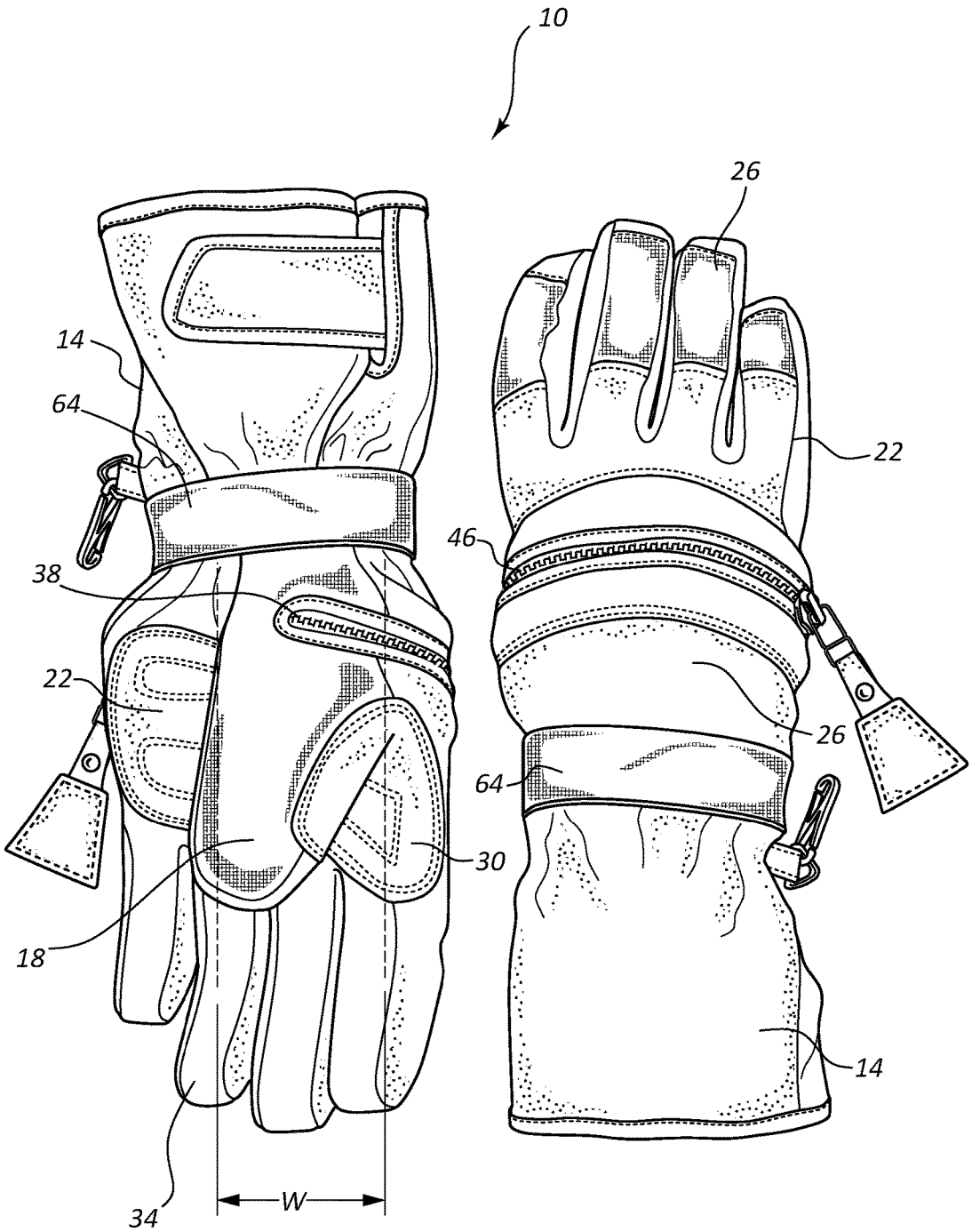
FIG. 6 is a bottom and top view, respectively from left to right on the page, of a hand covering in a closed configuration, consistent with embodiments disclosed herein.
Figure 7:
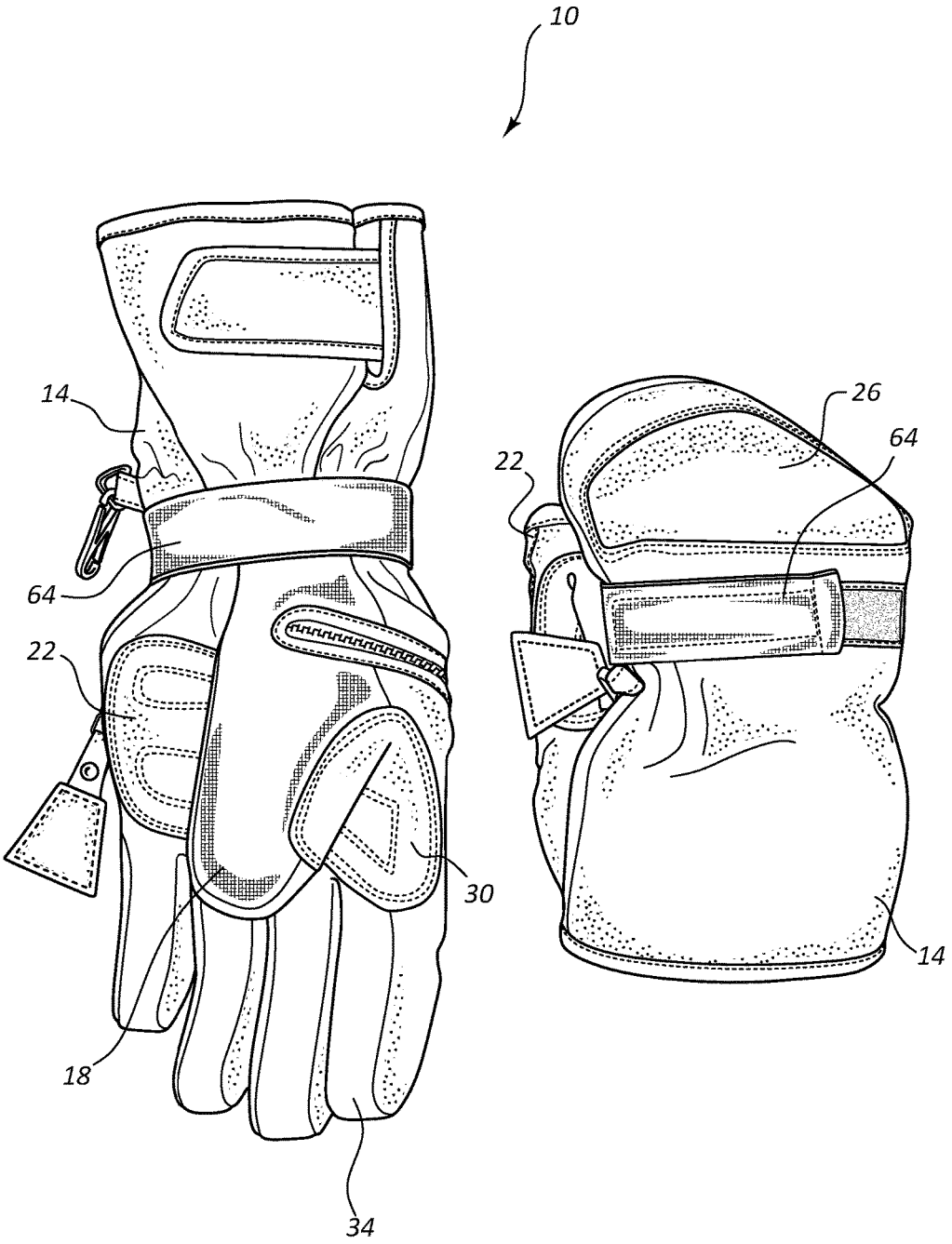
FIG. 7 is a bottom and top view, respectively from left to right on the page, of the hand covering of FIG. 6, with the bottom view showing the hand covering in a closed configuration and the top view showing the hand covering in an open configuration, consistent with embodiments disclosed herein.
Figure 8:
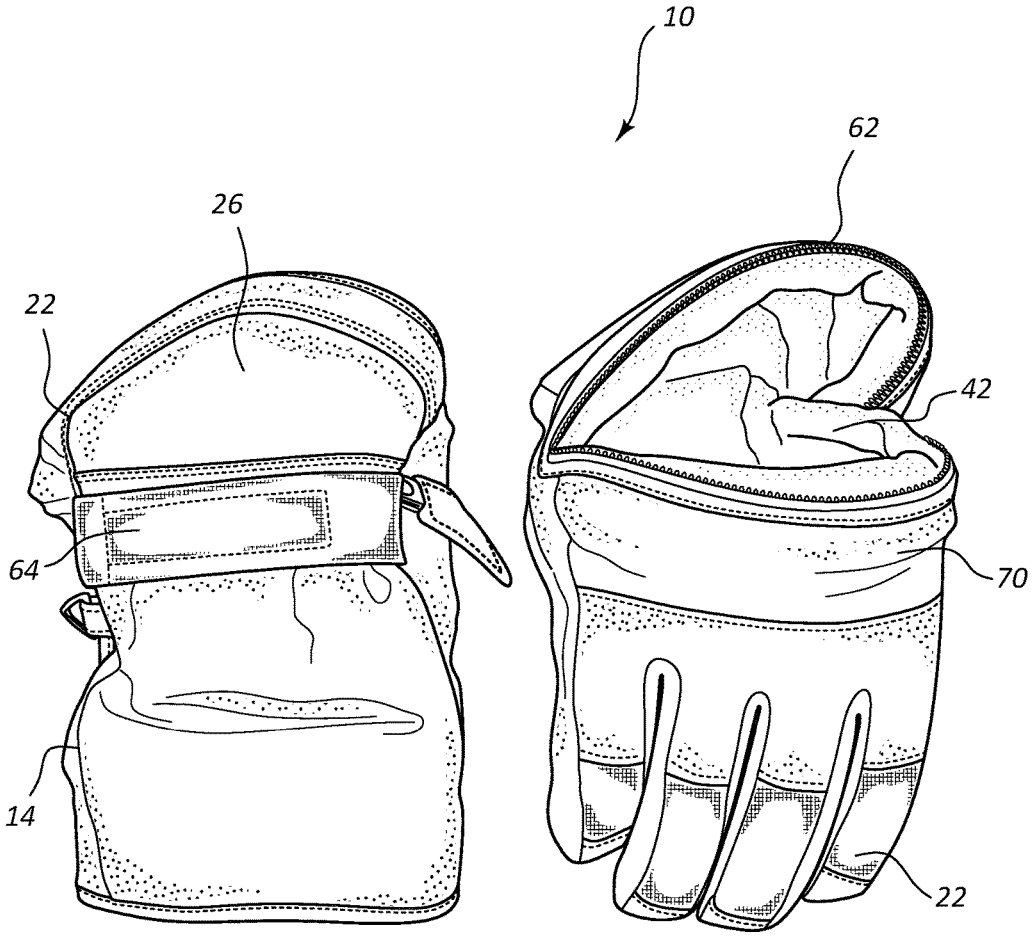
FIG. 8 is a top and bottom view, respectively from left to right on the page, of the hand covering of FIG. 6, with the top view showing the hand covering in an open configuration and the bottom view showing the hand covering in an open configuration, consistent with embodiments disclosed herein.
Figure 9:
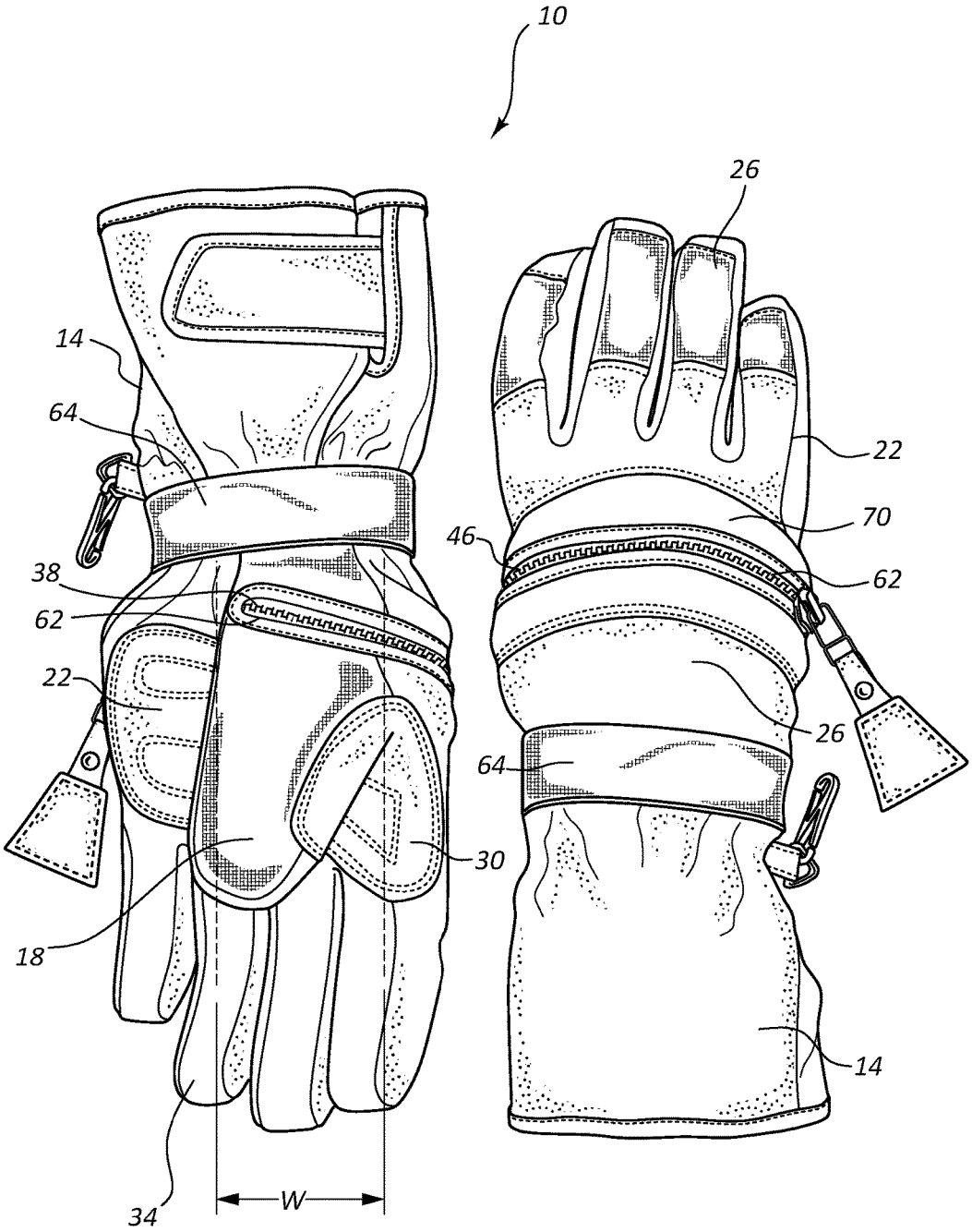
FIG. 9 is another bottom and top view, respectively from left to right on the page, of a hand covering in a closed configuration, consistent with embodiments disclosed herein.
Figure 10:
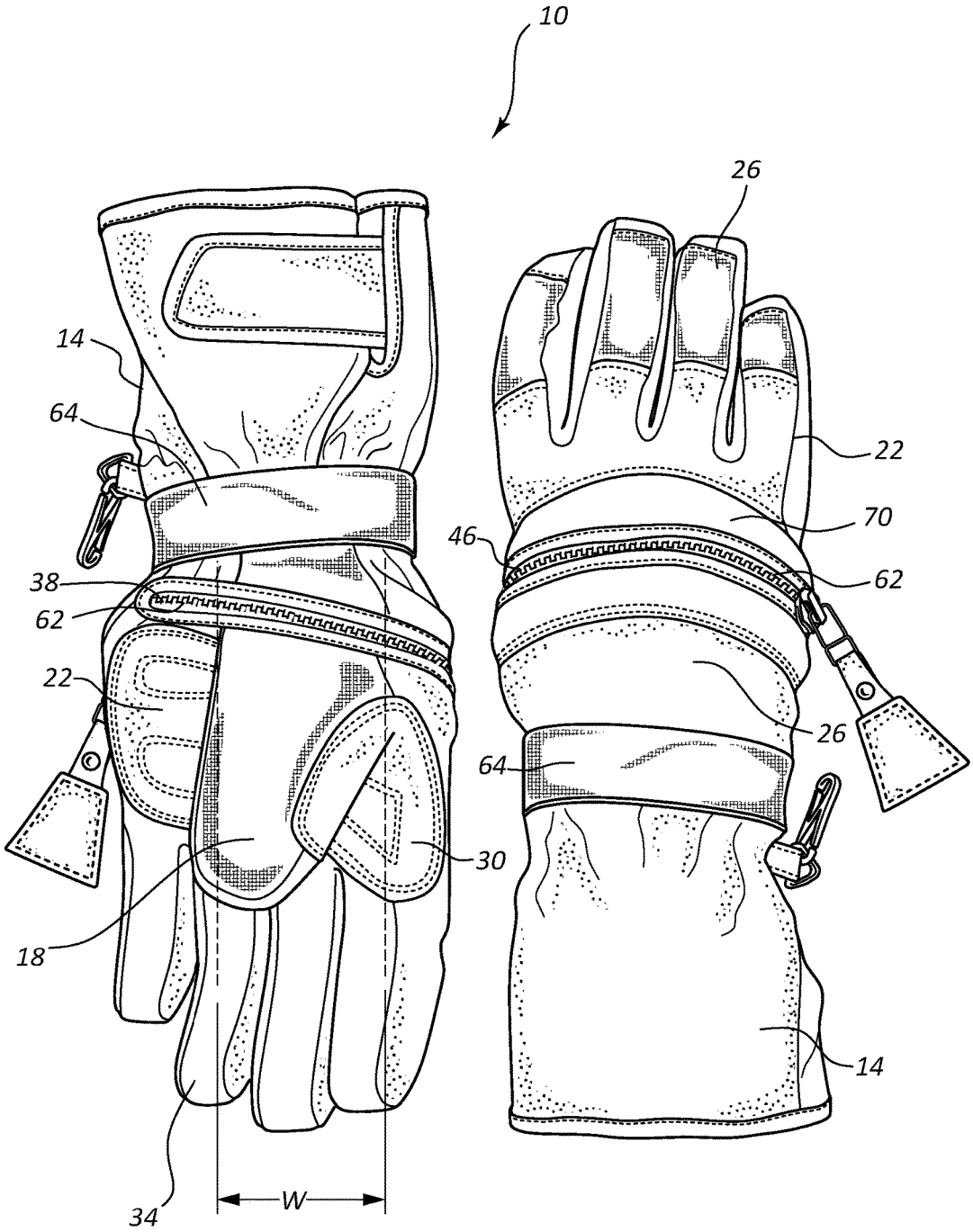
FIG. 10 is a further bottom and top view, respectively from left to right on the page, of a hand covering in a closed configuration, consistent with embodiments disclosed herein.

An opening 42 may be formed in the dorsal side 26 of the hand covering 10. The opening 42 and/or a portion thereof may be arcuate and/or otherwise curved in shape. Although the illustrated embodiments show a substantially arcuate opening 42, it will be appreciated that in further embodiments, portions of the opening 42 may not be arcuate and/or curved. The opening 42 may extend from a lateral portion 46 (e.g., as shown in FIGS. 9 and 10) that may be positioned or located laterally with respect to the hand covering 10 and/or positioned or located opposite of the thumb receptacle 18. In some embodiments, the thumb receptacle 18 may be considered to be located medially with respect to the hand covering 10. The opening 42 may extend from the lateral portion 46 across the dorsal side 26 of the hand covering 10 and to a medial portion 38 of the hand covering 10 that may be located at, near, or on the thumb receptacle 18 as illustrated in the figures. It will be appreciated that in various embodiments, the opening 42 may extend over a majority of a width W of the thumb receptacle 18 as illustrated in FIGS. 3 and 6; or the opening 42 may extend over substantially the entire width W of the thumb receptacle 18 as illustrated in FIG. 9; or the opening 42 may extend across and past the width W of the thumb receptacle 18 and into the palm portion 30 as illustrated in FIG. 10. In other embodiments, the opening 42 can extend from the lateral portion 46 to a point at the thumb receptacle 18 corresponding approximately to a metacarpophalangeal joint of the user. In further embodiments, the opening 42 can extend from the lateral portion 46 to a point at the thumb receptacle 18 corresponding approximately to a carpometacarpal joint of the user.

It will be appreciated that in some embodiments, the larger length of the opening 42, the greater finger and thumb dexterity may be permitted because of the ease in which the removal of the digits is allowed. Thus, five digit or five finger dexterity may be increased with a larger opening 42, as when the two hands of the wearer are located inside of the hand coverings 10, removal of the digits from the hand covering 10 may involve the wearer to navigate by opening (or closing) the opening 42, potentially with the digits inside the finger and thumb receptacles 34 and 18 in at least one hand.

In certain embodiments, the opening 42 may permit or allow the digit receptacle 34 and the thumb receptacle 18 to be removed from the fingers and thumb of the wearer (see e.g., FIGS. 1, 2, 4, 5, 7, and 8). When both hands of a wearer are located inside the hand coverings 10, it may be more difficult to maneuver a user's digits and thumb due to the covering. As such, a wider opening 42 (e.g., as illustrated in FIGS. 9 and 10) may result in a greater ability to maneuver and remove the hand covering 10 from the wearer.

In some embodiments, to further assist in the opening articulation process, (e.g., partially detaching the hand portion 22 from the wrist/forearm portion 14 via opening 14), it will be appreciated that the opening 42 can be arcuate or curved and can extend across the dorsal side 26 of the hand covering 10 and outward toward a fingertip end of the hand covering 10 as illustrated. In further embodiments, the opening 42 can be shaped to correspond to a profile defined by a proximal knuckle of each finger and the thumb of the wearer's hand. In some embodiments, the opening 42 may comprise a curvature extending across the width W of the thumb receptacle 18 such that the opening crosses a point corresponding approximately to a metacarpophalangeal joint of the user and a point corresponding approximately to a carpometacarpal joint of the user. The opening 42 may further comprise an open position in which the finger and thumb receptacles 34 and 18 are removed from the wearer's fingers and thumb as shown in FIGS. 1, 2, 4, 5, 7, and 8 and a closed position as shown in FIGS. 3, 4, 6, 7, 9 and 10, in which the wearer's fingers and thumbs are covered.

In some embodiments, the dorsal side 26 of the hand covering 10 may comprise padding and/or material disposed proximate to the opening 42. In certain embodiments, the padding and/or material disposed proximate to the opening 42 may be thicker and/or otherwise additional to padding and/or material included in other portions of the hand covering 10. The padding or material may be located anterior of the opening 42 and/or be disposed in one or more positions parallel and/or substantially parallel to one or more portions of the opening 42. Among other things, this padding or material may operate and cause the wrist/forearm portion 14 of the hand covering 10 to lie flatter in alignment or to lie in line with respect to the hand portion 22, thereby permitting the closure device or closure fastener to more easily open and close because of the alignment of the two portions of the hand covering 10. In certain circumstances, without additional padding or material, due to the corresponding shape of the opening 42, the wrist/forearm portion 14 of the hand covering 10 may tend to rise above the hand portion 22, potentially making it more difficult (especially when a wearer's hand is in a hand covering in the closed position) for a wearer to close the closure device or closure fastener from an open to a closed position. Accordingly, use of additional padding or material consistent with embodiments disclosed herein may enable a wearer to better selectively open and close the opening 42 without substantially altering the curvature of the opening 42.

As shown in the figures (e.g., FIGS. 1 and 2), when removed from the fingers and thumb of the wearer, the digit receptacle 34 and thumb receptacle 18 may remain attached to the wrist/forearm portion 14, and the wrist/forearm portion 14 can remain attached to the wearer. In some embodiments, the wrist/forearm portion 14 may comprise an extended or enlarged cuff portion (sometimes referred to as a "gauntlet" style glove because of its extended cuff) in order to have the option of being tucked into or positioned over the top of the sleeve of the wearer's protective equipment to form a seal between the wearer's hand covering and other protective equipment, such as a coat, jacket or the like. In this manner, when the user or wearer removes the fingers and/or thumb from the receptacles 34 and 18, the user may not need to remove the entire glove from the wearer's hand, thereby saving the wearer from the time, effort, and difficulty of regloving and reforming the seal. Further, in this manner, the wrist/forearm portion 14 can maintain coverage of the dorsal side 26 of the wearer's hand when the finger and thumb receptacles 34 and 18 are removed from the wearer's fingers and thumb.

Despite the length of the opening 42, the hand portion 22, including the palm side 30, of the hand covering 10 may be substantially integral with the wrist/forearm portion 14 to thereby eliminate the complete detachment of the palm side 30 from the wrist/forearm portion 14 into two separate and distinct portions. The hand covering 10 can be bendable across the hand portion 22 on the palm side 30 to allow the hand portion 22 of the hand covering 10 to be removed downwardly from the wearer's fingers and thumb. For example, when the opening is in an open configuration, the remaining material may be flexible enough to allow the hand portion 22 to flex with regard to the wrist portion 14. Thus, the finger receptacle 34 and thumb receptacle 18, when removed from the wearer's fingers and thumb, can be bent away from the palm side 30 of the wearer's hand and toward the wrist/forearm portion 14 of the hand covering 10. In this manner, the fingers and thumb may be free to manipulate objects without interference by the finger and thumb receptacles 34 and 18, which might otherwise dangle directly below the fingers and thumb.

In some embodiments, a closure device or closure fastener 62 can be operatively attached to the opening 42. The closure device or closure fastener 62 can selectively open or close the opening 42. It will be appreciated that, while the closure device or closure fastener is generally shown in the figures as a zipper, other suitable closure or fastener devices as known in the art may also be used. For example the closure device or closure fastener 62 may comprise a hook-and-loop fastener, a magnetic fastener, a clasp, a button, a flexible cord, snaps, an overlapping flap of hand covering material, or any other suitable closure device or closure fastener without departing from the scope of the disclosure. In certain embodiments, the closure device or closure fastener 62 may comprise a weather resistant and/or substantially-weather resistant closure. For example, the closure device or closure fastener 62 may comprise a zipper with a waterproof sheeting (e.g., fabric-reinforced polyethylene) wrapped around the outside of the rows of zipper teeth. When the zipper is closed, the two facing sides of the plastic sheeting may be positioned together, thereby forming a weather-resistant and/or substantially weather-resistant seal.

As illustrated in the figures, the closure device or closure fastener 62 may comprise an oversized tab to permit the wearer to easily grasp and navigate the closure device or closure fastener 62 while the wearer's hand is inside the finger and thumb receptacles 34 and 18.

Figure 11:
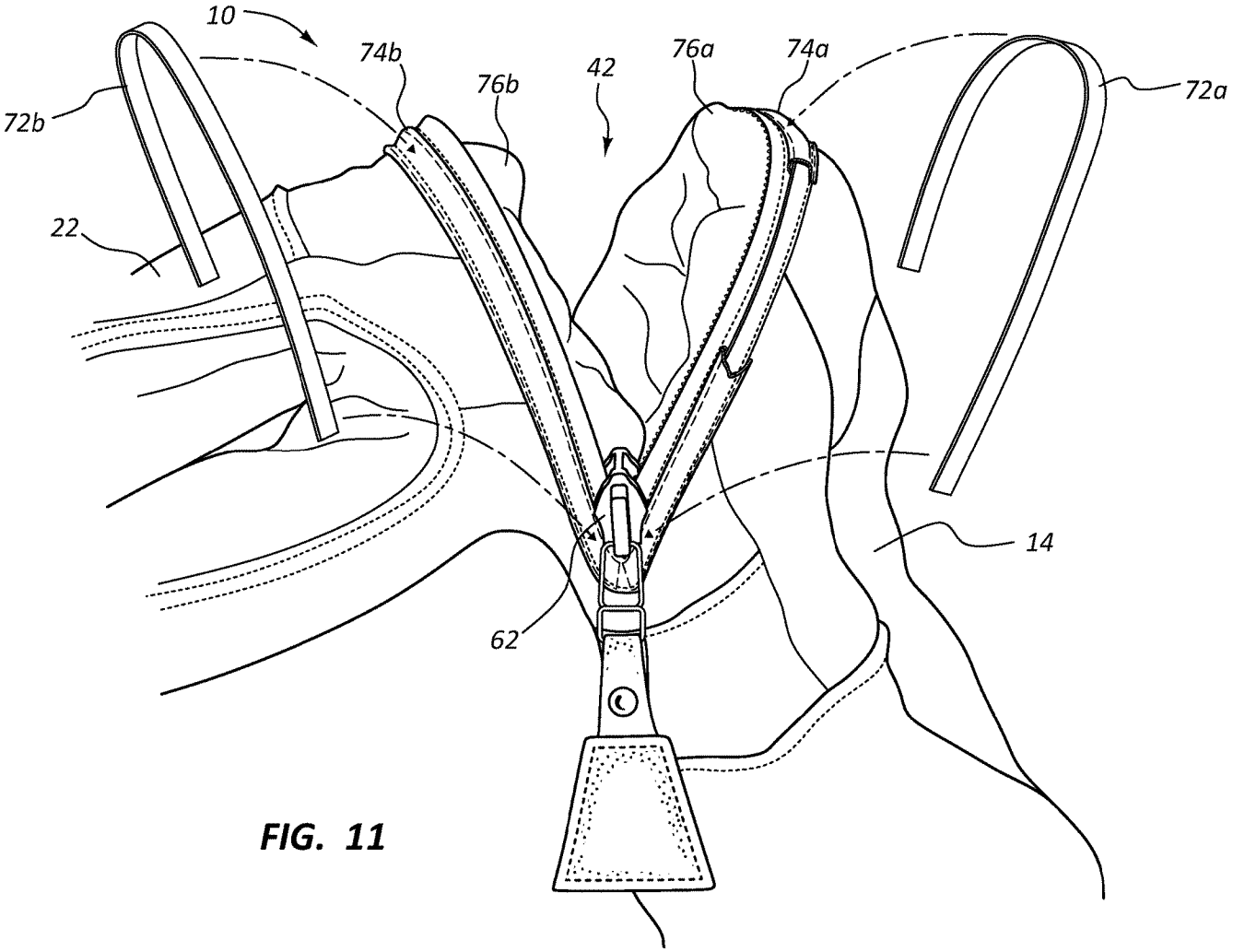
FIG. 11 illustrates a side view of a hand covering in an open configuration and associated structural members consistent with embodiments disclosed herein.

In further embodiments, the additional padding and/or more material may form a seal within the inside of the hand covering 10. For example, when the closure device or closure fastener 62 is in a closed position, the padding and/or material may be positioned together under the closure device or fastener 62, thereby further providing weather resistance to the closure device or fastener 62 and/or insulating an area under the closure device or fastener 62. As illustrated in FIG. 11, additional padding **76*a*, 76*b* may be disposed on each side of the opening 62 such that when the closure device or fastener 62 is closed, the padding 76*a*, 76*b* may meet under the closure device or fastener 62 to provide a weather resistant and/or insulated seal. In further embodiments, additional padding may be disposed on one side of the opening 62 (e.g., padding 76*a* or 76*b*) and be configured to extend across and underside of the closure device or fastener 62 to provide a weather resistant and/or insulated seal. It will be appreciated that the additional padding and/or more material may be disposed proximate to one or more portions of the closure device or fastener 62, and may have varied densities and/or thicknesses across portions of the closure device or fastener 62**.

Consistent with embodiments disclosed herein, and as shown in FIG. 11, the hand covering 10 may comprise one or more structural members 72*a*, 72*b* located proximate to the arcuate opening 42 and/or portions thereof. In some embodiments, the structural members 72*a*, 72*b* may be located in a position parallel and/or substantially parallel to the one or more sides of the arcuate opening 42 and/or a portion thereof. For example, as illustrated in FIG. 11, a first structural member 72*b* may be located in a position parallel and/or substantially parallel to a side of the arcuate opening 42 and/or a portion thereof corresponding with the hand portion 22 of the hand covering 10 and a second structural member 72*a* may be located in a position parallel and/or substantially parallel to a side of the arcuate opening 42 and/or a portion thereof corresponding with the wrist/forearm portion 14 of the hand covering 10. Although the embodiments illustrated in connection with FIG. 11 show structural members 72*a*, 72*b* on each side of the actuate opening 42, it will be appreciated that in other embodiments, a structural member (e.g., members 72*a* or 72*b*) may be disposed on only one side of the arcuate opening 42.

In certain embodiments, the structural members 72*a*, 72*b* may be affixed interior to a portion of the hand covering 10. For example, the structural members 72*a*, 72*b* may be disposed in respective interior channels 74*a*, 74*b* defined by the hand covering 10 and/or otherwise affixed at an internal location proximate to the arcuate opening (e.g., affixed using adhesive, sewing, and/or the like). In some embodiments, the interior channels 74*a*, 74*b* may comprise a sewn-in channel that allow the structural members 72*a*, 72*b* to be slid into place during manufacture. In further embodiments, the structural members 72*a*, 72*b* may be placed in a location corresponding to the interior channels 74*a*, 74*b* and secured within the channels 74*a*, 74*b* as they are formed (e.g., via a sewn-in process and/or the like).

In further embodiments, the structural members 72*a*, 72*b* may be affixed external to the hand covering 10. For example, the structural members 72*a*, 72*b* may be affixed to the hand covering 10 using an adhesive, stitching, and/or any other suitable mechanism. In yet further embodiments, the structural members 72*a*, 72*b* may be integral to a portion of the closure device or fastener 62.

Among other things, the structural members 72*a*, 72*b* may be configured to enable the user to selectively open and close the arcuate opening 42 without substantially altering the curvature of the arcuate opening 42. For example, the structural members 72*a*, 72*b* may stiffen the region near the arcuate opening 42 to allow a zipper and/or other closure device or closure fastener 62 to slide and/or otherwise articulate more easily along the opening 42. In certain embodiments, this may prevent the zipper, closure device or closure fastener 62 from binding as a user attempts to articulate the zipper, device, or fastener during operation. That is, the structural members 72*a*, 72*b* may reduce the potential for the hand covering 10 from substantially flexing when the user is selectively opening or closing the arcuate opening 42. In certain circumstances, this may better enable a user to fasten or release the opening 42 using a single hand.

The structural members 72*a*, 72*b* may comprise a variety of suitable materials and be configured in a variety of suitable ways. For example, the structural members 72*a*, 72*b* may comprise plastic, metal, rubber, fabric and/or any other suitable material and/or combination thereof. In some embodiments, the structural members 72*a*, 72*b* may comprise a material that is more rigid or inflexible than other portions of the hand covering 10 proximate to the arcuate opening 42. The structural members 72*a*, 72*b* may comprise a variety of shapes. For example, the structural members 72*a*, 72*b* may have a hollow and/or partially-hollow profile, may be flat, may be U-shaped, T-shaped, and/or L-shaped, and/or the like. In further embodiments, the materials, profiles, and/or shapes structural members 72*a*, 72*b* may vary across the members 72*a*, 72*b*. For example, in some embodiments, the structural members 72*a*, 72*b* may vary in flexibility across the length of the structural members 72*a*, 72*b*, providing varied support across the sides of the opening 42. In yet further embodiments, the structural members 72*a*, 72*b* may comprise one or more locations having increased flexibility (e.g., flex-points and/or the like).

In certain embodiments, the flexibility of the structural members 72*a*, 72*b* may allow a user of the hand covering 10 to articulate their hand within the hand covering 10 without substantial resistance, while substantially maintaining the shape of the arcuate opening 42 during operation of the closure device or fastener 62.

In further embodiments, the structural members 72*a*, 72*b* may comprise a portion of material surrounding the arcuate opening 42 that is rigid and/or more rigid to improve ease in closing or opening the opening using the device and/or fastener 62. In some embodiments, a similar fabric or material may be used but may be packed with more padding, more dense padding, or the like to increase resistance of the portion to changing shape. The portion of the material surrounding the arcuate opening 42 may still be a soft and flexible material, but may be stuffed more densely or include additional padding layers to keep a desired shape of the material on one or both sides of the arcuate opening 42. For example, the extra padding, thicker fabric, a strip or length of fabric, or material may be included near the opening 42 may stiffen the region near the opening 42 to allow a zipper to slide more easily along the arcuate opening 42. In certain embodiments, the structural members 72*a*, 72*b* may comprise additional padding 76*a*, 76*b* as described above.

Figure 12:
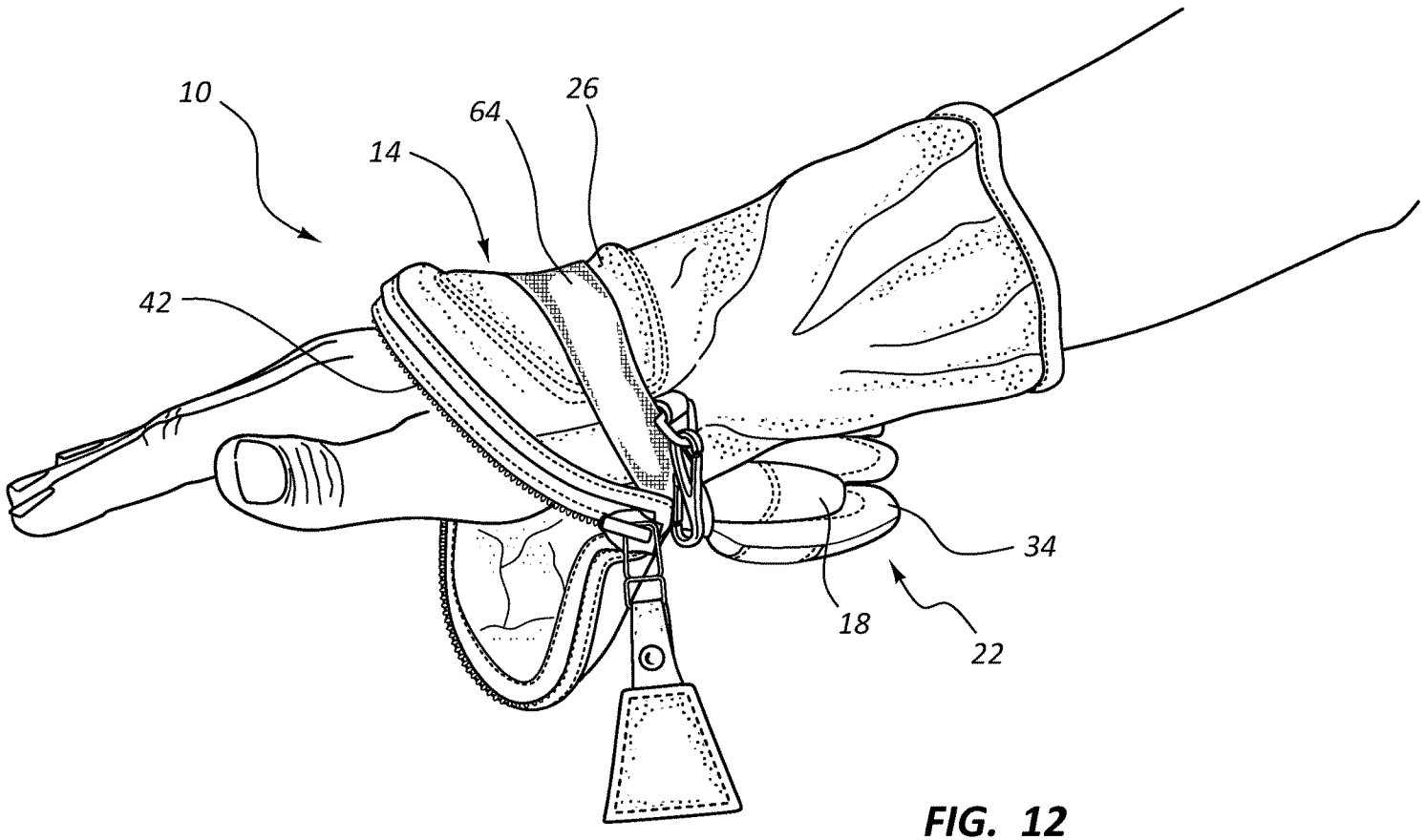
FIG. 12 illustrates a side view of a hand covering in an open configuration and an associated securing device consistent with embodiments disclosed herein.

As illustrated in FIG. 12, a securing device 64, such as a strap or other securing device, can be operatively coupled to the wrist/forearm portion 14. In some embodiments, the securing device 64 can be operable to temporarily secure the hand portion 22 beneath the wrist/forearm portion 14. In the secured position illustrated in FIG. 12, interference between the hand portion 22 and the wearer's bare fingers and thumb may be reduced when the hand portion 22 is removed from the wearer's fingers and thumb, and the hand portion 22 is bent toward the wrist/forearm portion 14. It will be appreciated that, while the securing device is generally shown as a stretchable chord or strap, other suitable securing devices as known in the art may also be used. For example the securing device may comprise a hook-and-loop fastener, a clasp, a button, a flexible cord, a snap, a magnetic closure, etc. may be used without departing from the scope of the disclosure. In some embodiments, a releasable strap may be provided that operates to cinch the wrist/forearm portion about the wrist of a wearer during "normal" use and can be released from this position and wrapped about the hand portion 22 when folded beneath the wrist/forearm portion 14 and re-cinched about both the wrist/forearm portion 14 and the hand portion 22 to secure the hand portion 22 out of the way of the fingers and thumb. The releasable strap can be secured in both positions with a buckle, hook-and-loop and fastener, etc. The releasable strap can also be formed of or include an elastic material to allow the strap to stretch and more tightly secure the hand covering sections.

In various figures illustrated, the hand covering 10 is shown and configured as a glove or a mitten which encloses a human hand, fingers and thumb. Such hand coverings 10 are shown with the opening 46 in an open and closed position. In the glove configuration, the hand portion 22 may include a plurality of finger receptacles 34 and a thumb receptacle 18. The opening 46 can extend rearwardly through the wrist/forearm portion 14 and terminate at an opening 46 of the covering 10. The closure device or closure fastener 62 can extend the length of the opening 46 to open or close some or all of the opening 46.

In certain figures, a pair of hand coverings 10 is shown each in a fully open position. In such a configuration, the operation of the hand coverings 10 may be similar to a single hand covering 10. In this configuration, the opening 46 may end from one side 38 of the hand covering 10, rearwardly through the wrist/forearm portion 14 and may terminate at portion 64 of the covering 10. In this manner, an inside of the hand coverings 10 can be substantially exposed when the opening 46 is in an open position. This configuration may be advantageous in that an open able hand covering is provided that also has the benefit of being fully openable to vent the inside of the hand coverings 10. This configuration can be advantageously utilized to dry the internal portions of the hand coverings after becoming wet with perspiration, rain, snow, etc.

As illustrated in the figures, a flexible material 70 may be located posteriorly with respect to the closure device or closure fastener 62. Such a flexible material may be an improvement in the art because it permits additional mobility and dexterity while a wearer's hand is inside the hand covering 10.

In some embodiments, the hand covering 10 may include an inner insert disposed within the hand covering 10. For example, the inner insert may include a removable glove or other inner layer to increase warmth or padding for a user's hands. In some embodiments, the inner insert may be positioned between the inner and outer layers that form the hand covering 10. The insert may be manufactured from a wind and water proof polyurethane material and may be surrounded by a fiber fill material, which thereby allows the hand covering to be absorbent and to facilitate absorption of moisture from within the hand covering to aid in removing perspiration, water, etc., from contact with the wearer's hand. The insert can comprise an opening similar in shape and function to the opening 42 to allow the insert to be selectively removed from the wearer's digits while still covering the dorsal side of the wearer's hand. For example, the inner insert may include an arcuate opening similar in shape and position to the arcuate opening 42 of the hand covering 10. In one embodiment, the arcuate opening may be a slit without any fastening mechanism. In one embodiment, the arcuate opening may include a fastener to selectively secure the opening on the inner insert in a closed or open position. Thus, the inner insert may be selectively removed from the user's thumb and/or digits while a portion remains on a portion of the user's hand or wrist.

The insert may comprise a three-layer microporous silicon coating structure. The insert may be impregnated with microscopic aluminum flakes to enhance heat retention characteristics. The first layer may prevent water from passing through the insert. It will be appreciated that the pores may be less than 0.5 um in diameter. The second layer may comprise a honeycomb structure that lets moisture in to let it expel through the first layer. The third layer may comprise a relatively dense material dense for added protection against water and may comprise the layer closest to the skin.

In addition to the embodiments discussed above, the disclosure also provides a method for covering a hand while providing selective access to objects by bare fingers and a thumb of a wearer. The method can include the step of enclosing the wearer's hand with a hand covering 10 that can have a dorsal side and a palm side and can include a wrist and/or forearm and a hand portion. A closure device or closure fastener can be operably attached to an opening formed in the dorsal side of the hand covering between the hand portion 22 and the wrist and/or forearm portion 14 can be opened. The method can include the step of parting the hand covering 10 at the opening 42 to expose the fingers and thumb of the wearer while maintaining coverage of a dorsal portion of the wearer's hand. The method can include the step of bending the hand covering about the palm side of the hand covering 10 downwardly from the wearer's hand.

The foregoing description has been presented for the purposes of illustration and description. It is not intended to be exhaustive or to limit the disclosure to the precise form disclosed. Many modifications and variations are possible in light of the above described embodiments. Further, it should be noted that any or all of the aforementioned alternate embodiments may be used in any combination desired to form additional hybrid embodiments of the disclosure. For example, throughout this specification, any reference to "one embodiment," "an embodiment," or "the embodiment" means that a particular feature, structure, or characteristic described in connection with that embodiment is included in at least one embodiment. Thus, the quoted phrases, or variations thereof, as recited throughout this specification are not necessarily all referring to the same embodiment.

Likewise, benefits, other advantages, and solutions to problems have been described above with regard to various embodiments. However, benefits, advantages, solutions to problems, and any element(s) that may cause any benefit, advantage, or solution to occur or become more pronounced, are not to be construed as a critical, a required, or an essential feature or element. Although specific implementations of the disclosure have been described and illustrated, the disclosure is not to be limited to the specific forms or arrangements of parts so described and illustrated. The scope of the disclosure is to be defined by the claims appended hereto, any future claims submitted here and in different applications, and their equivalents.

What is claimed is:

1. A hand covering having a dorsal side and a palm side and comprising:

a wrist portion for encompassing at least a portion of a wrist of a user;

a hand portion comprising a digit receptacle and a thumb receptacle, wherein the thumb receptacle is located on the palm side at or near a thumb side of the hand covering;

an arcuate opening extending from at or near a lateral side across the dorsal side and to the thumb receptacle, wherein the lateral side comprises a side of the hand covering opposite the thumb side;

a closure fastener operably attached to the arcuate opening and configured to open and close the arcuate opening, wherein, in an open configuration, the user can remove a thumb and one or more digits from the hand portion without removing the wrist portion from a wrist of the user; and a first structural member separate from a structure of the closure fastener enclosed within a first internal channel defined in the hand covering parallel to at least a portion of a first side of the arcuate opening, the first structural member comprising a first elongated strip of material that is more rigid than one or more other areas of the hand covering proximate to the first side of the arcuate opening, the first structural member being configured to structurally maintain a curvature of the first side of the arcuate opening and to enable the user to open and close the arcuate opening without substantially altering the curvature of the first side of the arcuate opening.

2. The hand covering of claim 1, wherein the thumb receptacle has a thumb receptacle width and the arcuate opening extends from the lateral side to the thumb receptacle and across substantially an entire width of the thumb receptacle.

3. The hand covering of claim 1, wherein the arcuate opening has a curvature corresponding to a natural shape of a user's knuckles.

4. The hand covering of claim 1, wherein, in the open configuration, the palm side comprises a flexible portion configured to allow the hand portion of the hand covering to be flexed relatively to the wrist portion to move away from the user's thumb and digits.

5. The hand covering of claim 1, wherein the first elongated strip comprises at least one of a metal material, a plastic material, a rubber material, and a leather material.

6. The hand covering of claim 1, wherein the arcuate opening extends from the lateral side to a portion of the thumb receptacle approximately corresponding to a location of a metacarpophalangeal joint of the user.

7. The hand covering of claim 1, wherein the arcuate opening extends from the lateral side to a portion of the thumb receptacle approximately corresponding to a location of a carpometacarpal joint of the user.

8. The hand covering of claim 1, wherein the arcuate opening extends from the lateral side to a portion of the thumb receptacle, and wherein the arcuate opening extends across the thumb receptacle from a point approximately corresponding to a metacarpophalangeal joint of the user to a point approximately corresponding to a carpometacarpal joint of the user.

9. The hand covering of claim 1, wherein the wrist portion further comprises an extended cuff portion, wherein the extended cuff portion extends at least to about a distal radio-ulnar joint of the user.

10. The hand covering of claim 1, wherein the wrist portion comprises a frictional material configured to inhibit movement between the wrist portion and protective equipment of the user.

11. The hand covering of claim 1, wherein the wrist portion comprises a frictional material configured to inhibit movement between the wrist portion and the wrist of the user.

12. The hand covering of claim 1, wherein the closure fastener is selected from a group consisting of a zipper, a magnetic fastener, a hook-and-loop fastener, a clasp, a button, a cord, a snap, or an overlapping flap of a hand covering material.

13. The hand covering of claim 1, wherein at least a portion of the first elongated strip comprises a material having at least one of a flat profile, a U-shaped profile, a L-shaped profile, a hollow profile, and a partially hollow-profile.

14. The hand covering of claim 1, wherein the first structural member comprises at least one flex point.

15. The hand covering of claim 1, wherein the first structural member varies in flexibility along its length.

16. The hand covering of claim 1 further comprising:

a second structural member separate from the structure of the closure fastener and enclosed within a second internal channel defined in the hand covering parallel to at least a portion of a second side of the arcuate opening, the second structural member comprising a second elongated strip of material that is more rigid than one or more other areas of the hand covering proximate to the second side of the arcuate opening, the second structural member being configure to structurally maintain a curvature of the second side of the arcuate opening and to enable the user to open and close the arcuate opening without substantially altering the curvature of the second side of the arcuate opening.

* * * * *